United States Patent [19]

Liu

[11] Patent Number: 4,616,297

[45] Date of Patent: Oct. 7, 1986

[54] SPECTACLES-LIKE ILLUMINATING DEVICE

[76] Inventor: Ju-Fu Liu, No. 720, Tung Ta Road, Shin Chu, Taiwan

[21] Appl. No.: 789,021

[22] Filed: Oct. 18, 1985

[51] Int. Cl.[4] ..... F21L 15/14

[52] U.S. Cl. ..... 362/105; 362/184; 362/249

[58] Field of Search ..... 362/105, 184

[56] References Cited

U.S. PATENT DOCUMENTS

| | | | |
|---|---|---|---|
| 1,615,067 | 1/1927 | Boerman | 362/105 |
| 1,741,264 | 12/1929 | Wappler | 362/105 |
| 1,879,512 | 9/1932 | Rotea | 362/105 |
| 2,289,488 | 7/1942 | Dritsas | 362/105 |
| 3,634,676 | 1/1972 | Castellano | 362/105 |
| 3,683,168 | 8/1972 | Tatje | 362/105 |

*Primary Examiner*—E. Rollins Cross

*Attorney, Agent, or Firm*—Bacon & Thomas

[57] ABSTRACT

This invention relates to a spectacles-like illuminating device and particularly to one which comprises a frame. A pair of supporting members are pivotally connected to both ends of the frame. A pair of lamp sockets with lamps disposed therein are respectively secured to a pair of cylindrical members each of which can be pivotally connected to each end of the frame thereby the illuminating direction of the lamp capable of being adjusted to meet the requirements of the user.

1 Claim, 4 Drawing Figures

SPECTACLES-LIKE ILLUMINATING DEVICE

BACKGROUND OF THE INVENTION

Sometimes, in our daily life, we have to work in the dark owing to unexpected reasons such as power failure in the night. Under such circumstance, the conventional electric torch becomes the most important illuminating device for us to proceed our job.

However, there are some disadvantages when using the conventional electric torch. That is, we usually have to hold the electric torch with one hand while do our job with the other hand therefore significantly reducing the working efficiency. Besides, the illuminating direction of the conventional electric torch is unchangable thereby lacking flexibility.

It is, therefore, an object of the present invention to obviate and mitigate the above-noted drawbacks.

SUMMARY OF THE INVENTION

It is the primary object of the present invention to provide a spectacles-like illuminating device which can be supported on the ears of the user instead of holding by hand while the illuminating direction of the lamp can be adjusted according to the user's requirements.

It is still another object of the present invention to provide a spectacles-like illuminating device which is easy to fabricate.

It is a further object of the present invention to Provide a spectacles-like illuminating device which is practical for use.

DETAILED DESCRIPTION OF THE PREFERRED EMBODIMENT

Figure 1:
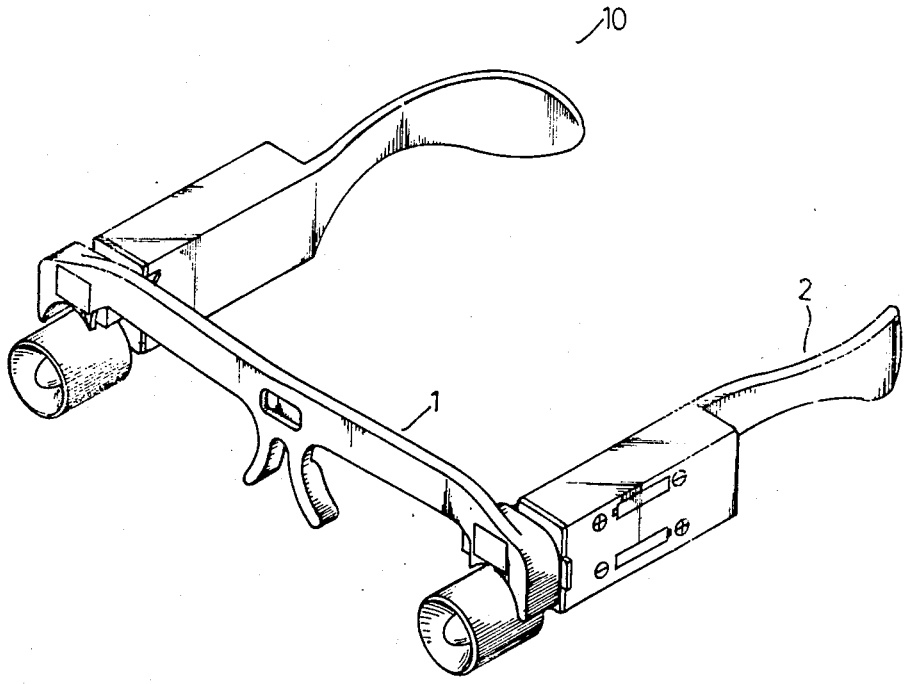
FIG. 1 is a perspective view of a preferred embodiment of the present invention.
Figure 2:
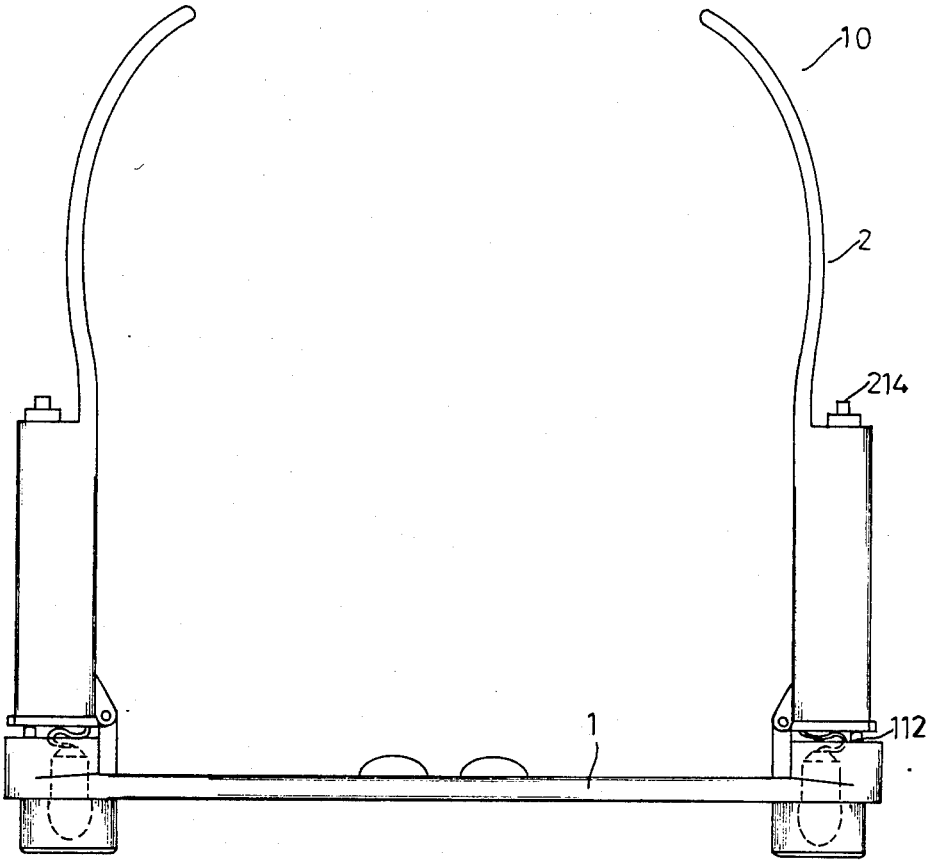
FIG. 2 is a top view of FIG. 1.
Figure 3:
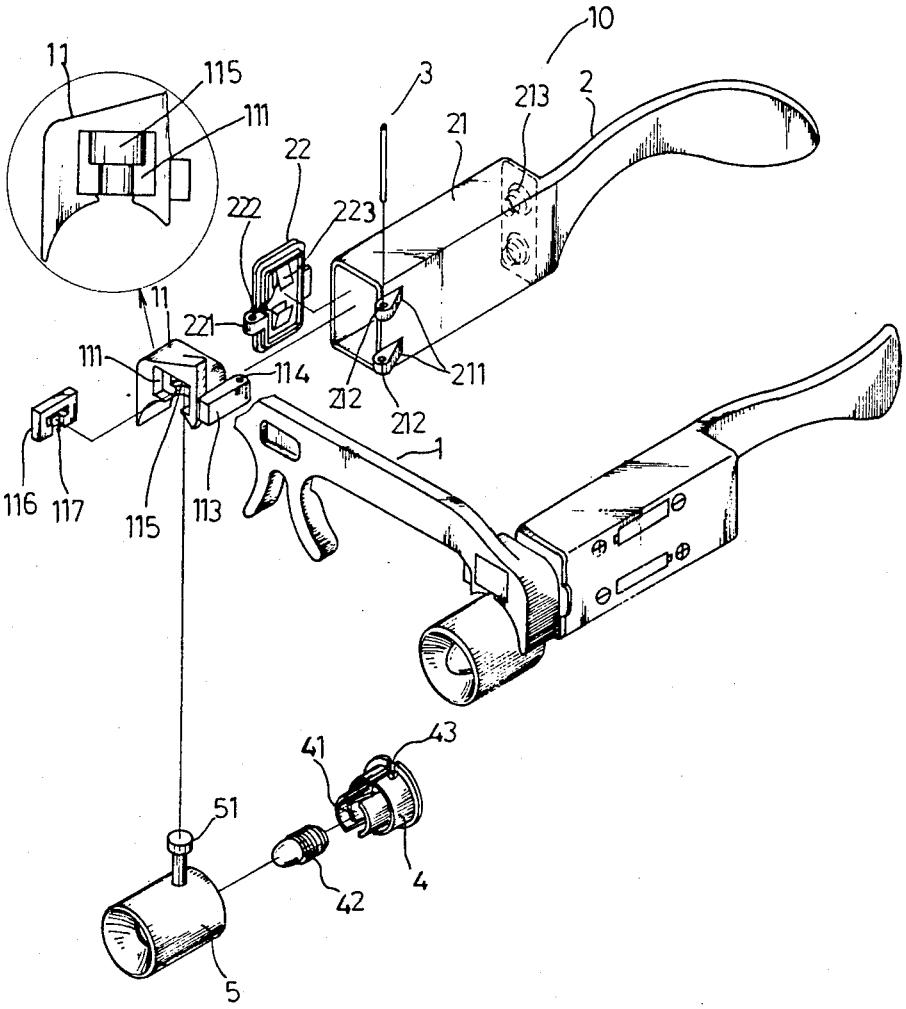
FIG. 3 is a fragmental perspective view of FIG. 1.

Referring to the drawings and particularly to FIG. 3, the spectacles-like illuminating device (10) comprises a frame (1) provided at the both ends with a pair of seats (11) each of which is formed at the front side with a recess (111) in which a T-shaped slot (115) is formed. A plate (116) arranged to cooperate with the recess (111) thereof is provided at its inner side with a T-shaped slot (117) which corresponds to the T-shaped slot (115) of the recess (111). The inner edge of each seat (11) is furnished with a block (113) having an aperture (114) formed thereon. A pair of supporting members (2) each of which is provided with a battery chamber (21) of which the outside is furnished with a pair of blocks (211) each having a hole (212). The rear wall of the battery chamber (21) is provided at its inner side with springs (213). A cover (22) is provided at the inner side with metal conductors (223) which are arranged to be associated with the springs (213) of the battery chamber (21) to clamp the batteries received therein to provide the electric power for this present invention. A switch (214) (FIG. 2) is mounted on the rear side of each battery chamber (21) to control the ON-OFF of the electric power. The inner side of the cover (22) is provided with a blocks (221) having a hole (222) formed thereon. A pin (3) is arranged to pass the holes (212) of the bocks(211) of the supporting member (2) through the aperture (114) of the block (113) of the seat (11) and the hole (222) of the block (221) of the cover (22) so as to make the cover (22) pivotally connected to the battery chamber (21) while the supporting member (2) pivotally joined to the seat (11) of the frame (1) so that the supporting member (2) is foldable in respect to the frame (1). A protuberance (112) (FIG. 2) is disposed on the rear side of each seat (11) to prevent the corresponding supporting member (2) from moving outwardly.

Figure 4:
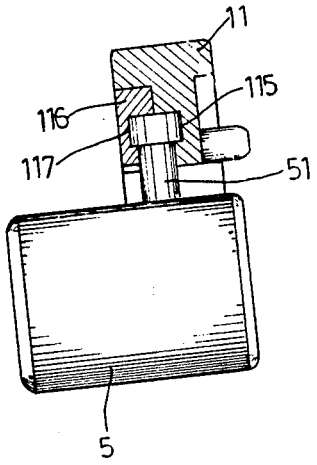
FIG. 4 is a cross-sectional view thereof showing the cylindrical member being pivotally connected to the seat of the frame.

A lamp socket (4) is provided with a pair of conductors (41) between which a lamp (42) is clamped. A pair of electric wires (not shown) through a notch (43) formed in the socket (4) are arranged to be respectively connected between the conductors (223) of the cover (22) and the conductors (41) of the lamp socket (4) to complete the electric circuit thereof. The lamp socket (4) with the lamp (42) disposed therein can be secured to a hollow cylindrical member (5) of which the outer periphery is furnished with a supporting means (51) of T-shaped cross-section. Referring to FIG. 4, the cylindrical member (5) is arranged to be pivotally connected to the seat (11) of the frame (1) with the supporting means (51) clamped by the seat (11) and the plate (116) while received within the T-shaped slots (115) and (117) thereof. Such arrangement can make the cylindrical member (5) rotate about its supporting means (51) thereby the lamp (42) therein capable of changing its illuminating direction according to the requirements of the users.

Accordingly, this present invention can provide us a simple-structure, flexible-use illuminating device therefore significantly avoiding the disadvantages of the conventional electric torch.

I claim:

1. A spectacles-like illuminating device comprising:

a frame being provided at the both ends with a pair of seats, each seat being furnished at the one side with a recess in which a T-shaped slot is formed and at the other side with a protuberance;

a pair of plates each of which is arranged to cooperate with the recess of each seat and is provided at one side with a T-shaped slot which corresponds to the T-shaped slot of the corresponding recess;

a pair of supporting members each of which is arranged to be pivotally connected to each seat of the frame, each supporting member being provided with a battery chamber to receive the batteries, the rear wall of the battery chamber being provided at the inner side with springs while at the outer side with a switch, a pair of covers each pivotally connected to the corresponding recess being provided at the inner side with metal conductors which associate with the springs of each battery chamber to clamp the batteries received therein;

a pair of lamp sockets each of which is provided with a pair of metal conductors between which a lamp is clamped, the metal conductors of each lamp socket being electrically connected to the metal conductors of each cover to form a complete circuit;

a pair of hollow cylindrical members to each of which the corresponding lamp socket is secured, each cylindrical member being provided at the outer periphery with a supporting means of T-shaped cross-section which is arranged to be clamped between the T-shaped slot of the seat and the T-shaped slot of the plate to make each cylindrical member pivotally connected to the corresponding seat of the frame thereby the illuminating direction of the lamp disposed in the cylindrical member capable of being adjusted according to the requirements of the user.

* * * * *